United States Patent [19]

Baker

[11] Patent Number: 4,925,506

[45] Date of Patent: May 15, 1990

[54] PRINTING PLATE MOUNTING DEVICE AND METHOD

[76] Inventor: A. Leroy Baker, Post Office Box 2137, Burlington, N.C. 27216

[21] Appl. No.: 219,357

[22] Filed: Jul. 15, 1988

[51] Int. Cl.[5] ..... B65C 9/06; B41F 1/28

[52] U.S. Cl. ..... 156/64; 33/618; 101/415.1; 101/486; 101/DIG. 36; 156/447; 156/475; 156/510

[58] Field of Search ..... 101/216, 415.1, DIG. 36, 101/486, 481; 29/51; 33/617, 618; 156/447, 64, 215, 256, 270, 313, 475, 510

[56] References Cited

U.S. PATENT DOCUMENTS

| | | | |
|---|---|---|---|
| 2,711,691 | 6/1955 | Leavens, Jr. | 33/618 X |
| 3,390,633 | 7/1968 | Boughton | 33/618 X |
| 3,577,856 | 5/1971 | Updegraff | 33/618 |
| 3,616,055 | 10/1971 | Mages | 101/DIG. 36 |
| 3,983,808 | 10/1976 | Jackson | 101/DIG. 36 |
| 4,408,530 | 10/1983 | Yano et al. | 101/DIG. 36 |
| 4,449,452 | 5/1984 | Mansell | 33/617 X |
| 4,705,590 | 11/1987 | Vandenberg | 101/DIG. 36 |
| 4,735,663 | 4/1988 | Hasegawa | 101/DIG. 36 |
| 4,750,248 | 6/1988 | Brown | 29/51 |

FOREIGN PATENT DOCUMENTS

| | | | |
|---|---|---|---|
| 15471 | 9/1980 | European Pat. Off. | 101/DIG. 36 |
| 1940878 | 3/1970 | Fed. Rep. of Germany | 101/DIG. 36 |

*Primary Examiner*—Edgar S. Burr
*Assistant Examiner*—Moshe I. Cohen

[57] ABSTRACT

A mounting device and method for positioning a printing plate on a press cylinder utilizes a transparent planar surface having a grid thereon. A cylinder can be lowered into the cradle and adhesively retain a flexible printing plate which has been alinged on the grid. The method employed provides an efficient time saving and accurate mounting process.

6 Claims, 7 Drawing Sheets

PRINTING PLATE MOUNTING DEVICE AND METHOD

This of pending patent application Ser. No. 07/151,111 filed Feb. 1, 1988, now abandoned.

BACKGROUND OF THE INVENTION

1. Field Of The Invention

The invention herein pertains to printing and particularly to the mounting of flexographic printing plates on printing press cylinders.

2. Description Of The Prior Art And Objectives Of The Invention

In recent years many advances have been made in printing techniques and specifically in printing such as in the use of resilient polymer printing plates, hereinafter referred to as flexographic plates. Various techniques and devices have been tried in order to promptly mount such printing plates on press cylinders to insure that the plate is properly aligned. Misalignment of course can cause tremendous waste and expense and with the use of high speed presses with multiple printing cylinders, even one cylinder having a misaligned plate can cause extensive press downtime and wasted time and materials. Special measuring instruments have long been employed to insure correct plate alignment on the press but oftentimes, even with sophisticated instrumentation, registration is not achieved. One plate which is a fraction of an inch out of register can completely destroy a multicolor press run and result in the loss of hundreds or more dollars. Thus, techniques have been long sought in the printing industry to insure quick and correct plate positioning on the press cylinders.

The present invention was thus conceived with the disadvantages known of conventional plate alignment devices and methods and one objective of the present invention is to provide a mounting device for positioning a printing plate on a press cylinder which is simple to use and accurate in its results.

It is another objective of the invention herein to provide a mounting device which is relatively easy to learn to use and which is inexpensive to purchase.

It is another objective of the present invention to provide a mounting device which can be utilized by those with relatively little experience in the printing trade for a variety of printing plates.

It is also an objective of the plate invention to provide a method for mounting one or more printing plates on plate supports which will require little time and which will insure accurate plate alignment on the press.

Other advantages and benefits of the invention will become apparent to those skilled in the art as a more detailed description is presented below.

SUMMARY OF THE INVENTION

The aforesaid and other advantages of the present invention are realized by providing in one embodiment a mounting device which includes a base having a transparent surface. A printed grid is placed over the transparent surface and mounted thereto is a printing press cylinder cradle. The cradle is attached to the base whereby a press cylinder is positioned in the cradle and is directed downwardly to the printing plate placed face downwardly on the grid. The tacky outer surface of the cylinder adheres the plate to the cylinder. As the ends of the cylinder cradle are aligned on the grid, by aligning the plate on the grid, a correctly positioned plate on the press cylinder is assured. Another embodiment of the mounting device includes a tape supply and apparatus for accurately cutting the tape for easy application to the printing cylinder. A plate shelf may be utilized for insertion and expulsion of a plate support having a plate mounted thereon through the mounting device. A stacking frame allows for accurate alignment of multiple printing plates.

The method of the invention includes directing the press cylinder within the cradle into contact with the printing plate to touch its adhesive or tacky outer surface. By rotating the cylinder, the plate is then securely wrapped around the cylinder while the plate supports exits the mounting device and thereafter the cylinder with the attached plate is removed from the cradle and can be installed on the printing press for printing. A method of aligning a plurality of printing plates each on individual plate supports on a light table within a stacking frame is also described.

DESCRIPTION OF THE PREFERRED EMBODIMENT

Figure 5:
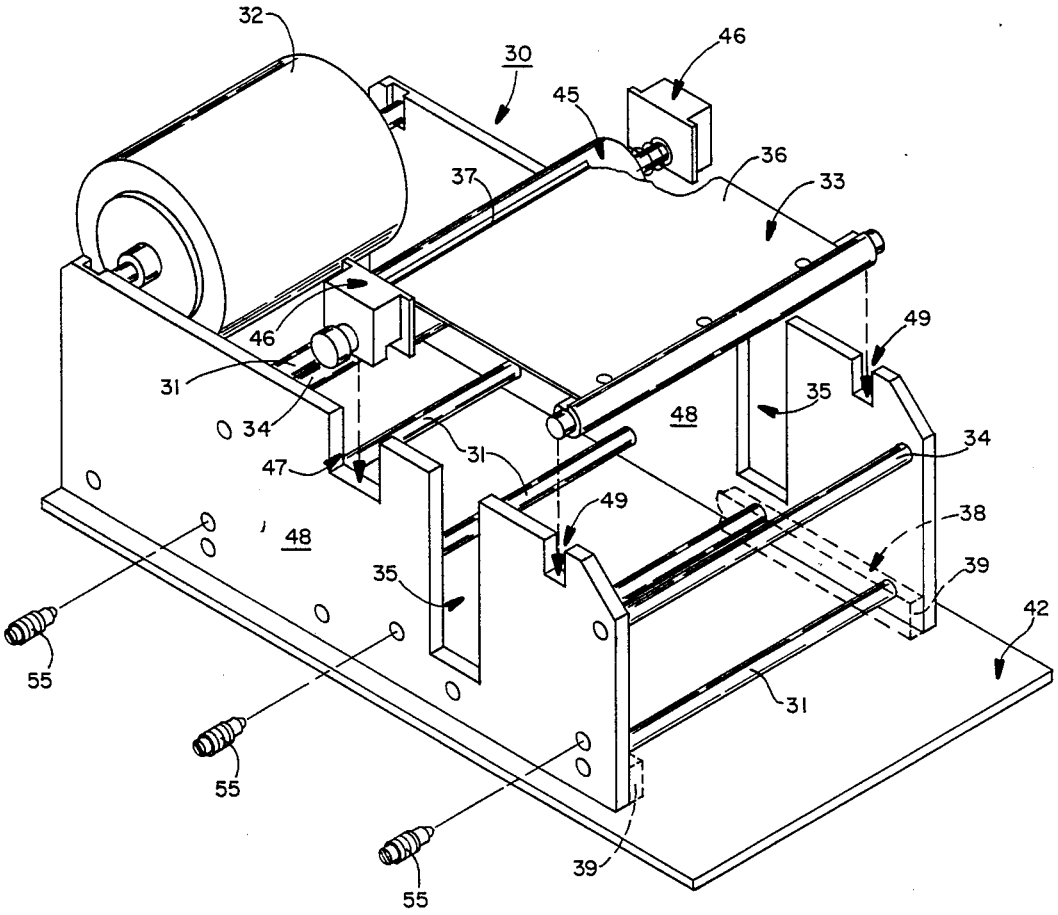
FIG. 5 is another embodiment of the mounting device shown in perspective fashion with certain components exploded therefrom.

The preferred form of the apparatus of the invention is seen in FIG. 5 with a tape supply and a tape cutting panel. A cylinder cradle includes a pair of slotted vertical planar end members with horizontal supports attached between the ends. The lower horizontal supports allow a plate support with a printing plate taped thereto to to be slid into and through the mounting device and simultaneous attachment of the plate to the plate cylinder. Tension is applied to one edge of the plate support as it passes through the mounting device.

The preferred method of the invention includes positioning a plate face downward onto the grid of a plate support. By directing the press cylinder into the cradle formed by the planar end members, the cylinder which has an adhesive outer surface can contact the back of the printing plate. Thereafter, by rotating the cylinder within the cradle the printing plate will wrap around the cylinder as the plate support exits the mounting device and the cylinder can thereafter be removed and placed on a press for printing. One or more printing plates can be aligned on subsequent transparent plate supports positioned on a light table within a stacking frame and upon removal therefrom, the printing plates can be attached to printing press cylinders as described above.

DETAILED DESCRIPTION OF THE DRAWINGS AND OPERATION OF THE INVENTION

Figure 2:
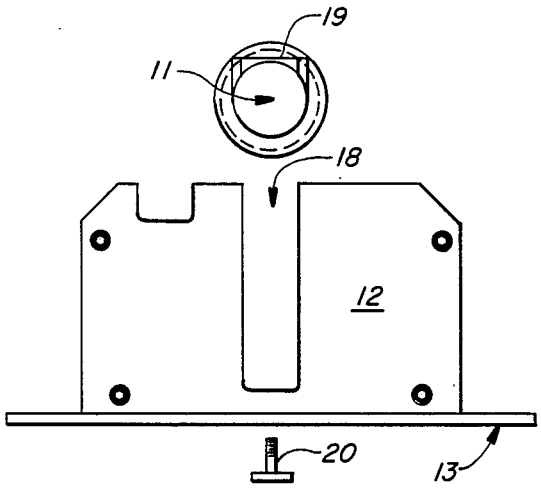
FIG. 2 demonstrates an end elevation view of the mounting device as shown in FIG. 1.
Figure 1:
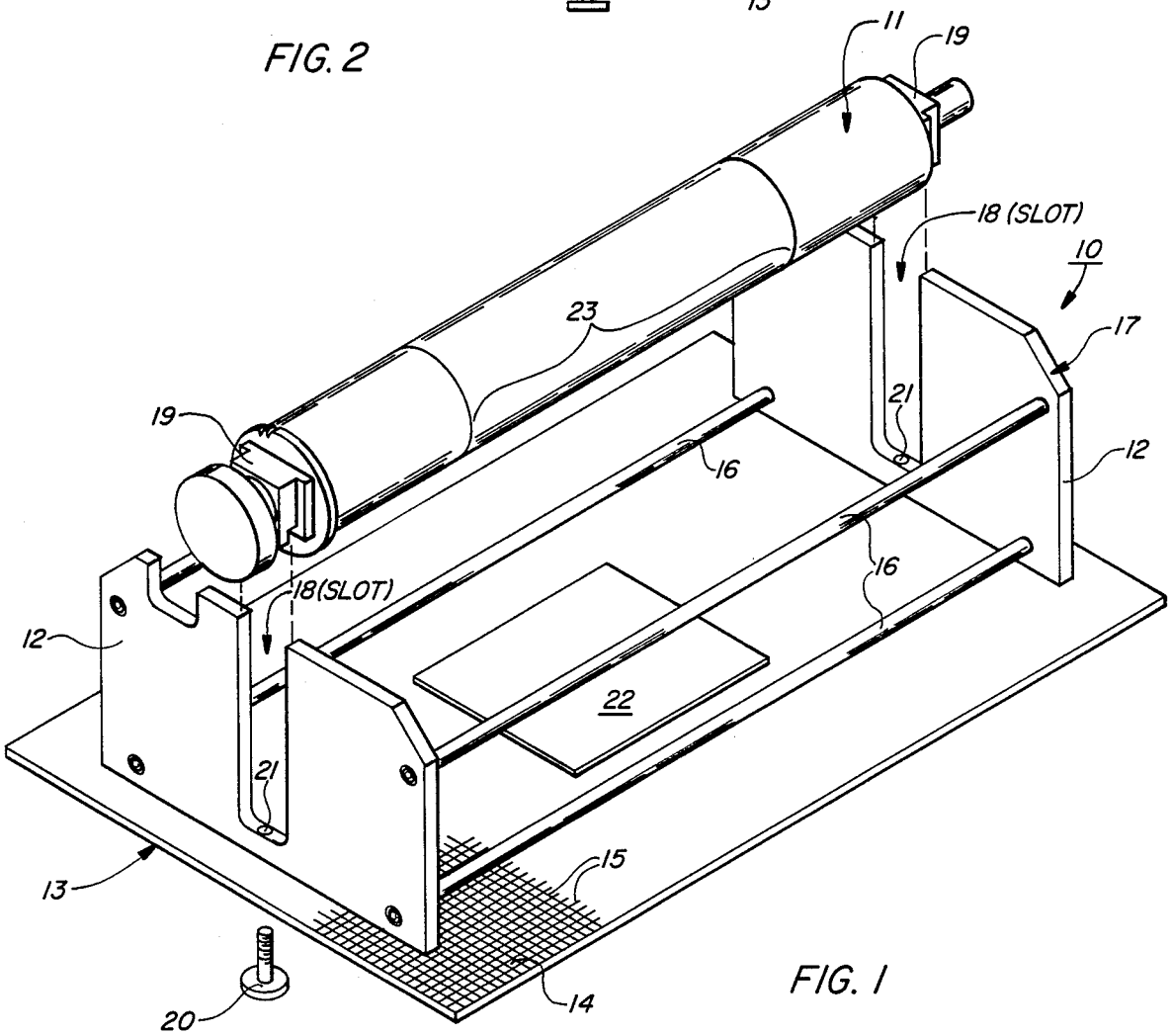
FIG. 1 demonstrates a top perspective view of the printing plate mounting device with the press cylinder positioned slightly above.
Figure 3:
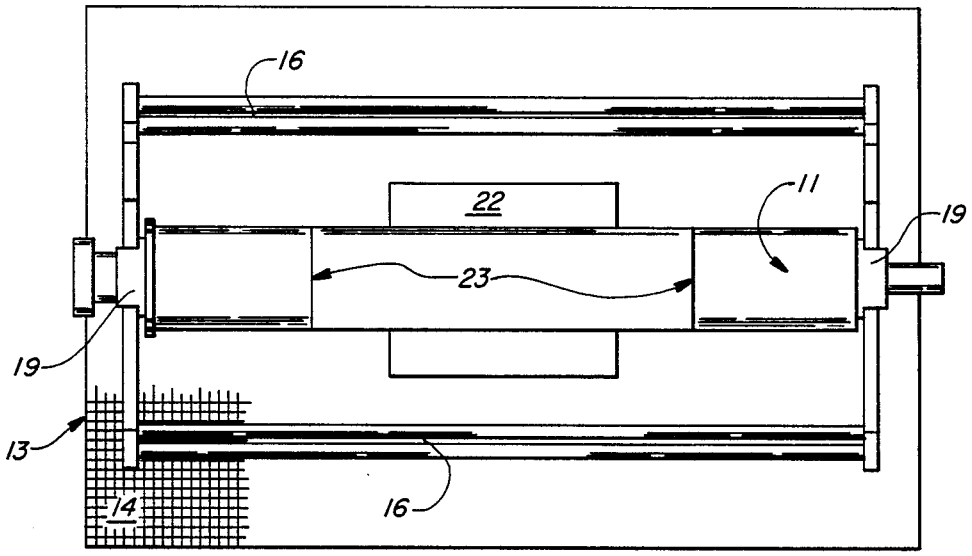
FIG. 3 demonstrates a top plan view of the mounting device as shown in FIG. 1 with the press cylinder therein.

Mounting device 10 is shown in top perspective view in FIG. 1 with press cylinder 11 positioned slightly above. Cylinder 11 may be for example, sixteen (16) inches in length. Device 10 includes planar ends 12 vertically mounted on base 13 which consists of a transparent material such as glass or a synthetic substance such as an acrylic plastic. Adhesively affixed to the top surface of base 13 is grid 14 which may be for example a thin clear transparent plastic sheet with black printed lines 15 thereon. Lines 15 are perpendicularly arranged and may form ¼ inch squares. Ends 12 are attached to base 13 by bolts (not shown) or the like to provide a firm attachment to base 13 and grid 14. Ends 12 and horizontal supports 16 form cylinder cradle 17 and by positioning cylinder 11 therein, cylinder 11 is "square" with grid 14. As seen in FIG. 1, ends 12 include a vertical slot 18 and as further seen in FIG. 3, cylinder axle bearings 19 slide into slots 18 with the depth of penetration terminated by adjusting means 20 (FIG. 1). Adjusting means 20 is threadably received in planar end 12 through threaded aperture 21. Adjusting means 20 allows cylinder 11 to be inserted into contact with plate 22 at adhesive section 23. As would be understood, plate 22 is a transparent, flexible printing plate formed from a conventional polymer substance and is made of sufficient thickness as specific requirements dictate. Section 23 may consist of an adhesive pad which is attached to cylinder 11 or may consist of an adhesive substance applied directly to the outer surface of cylinder 11. As cylinder 11 is directed downwardly into slots 18, adjusting means 20 on each side of cradle 17 are set so that the outer surface of cylinder 11 just touches printing plate 22 which is aligned face downwardly on grid 14. Once printing plate 22 is in adhesive contact with cylinder 11, cylinder 11 can be rotated in cradle 17 and plate 22 can then be completely wrapped therearound.

Figure 4:
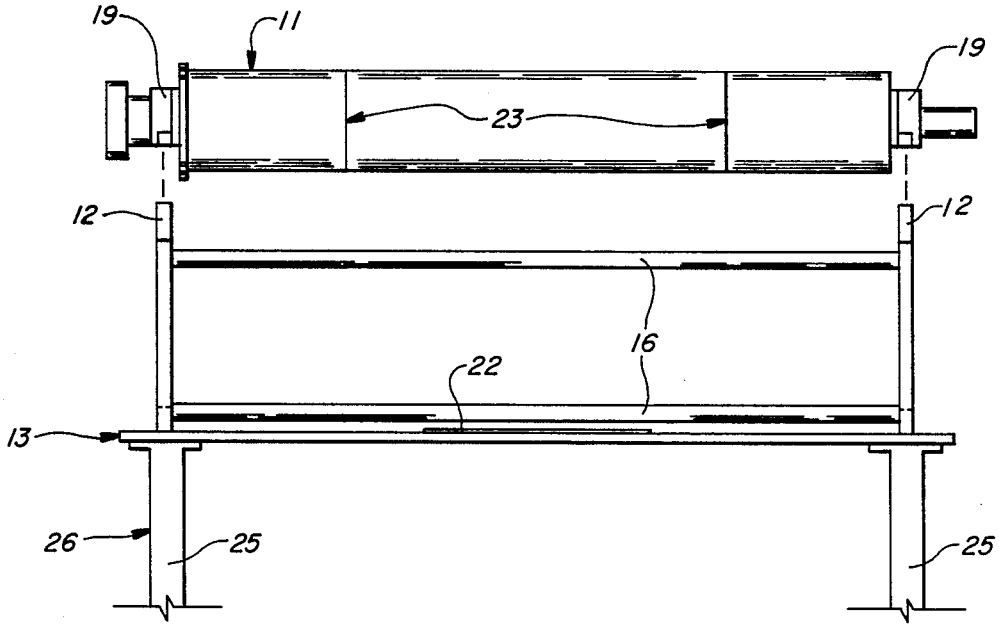
FIG. 4 demonstrates a front elevation of the mounting device and cylinder as shown in FIG. 1 but with attached legs.

In FIG. 4 legs 25 are shown attached to base 13 to form table 26 for supporting cradle 17. Other configurations of mounting device 10 could be designed so base 13 could then be positioned thereon. It has been found that by forming base 13 omitted part could then be placed thereunder to assist in the alignment of plate 22 on grid 14. As hereinbefore stated plate 22 is first aligned on grid 14 and thereafter, press cylinder 11 is directed downwardly within cylinder cradle 17 until slight contact is made between the outer surface of cylinder 11 and plate 22. Once contact with cylinder 11 has been made, cylinder 11 is rotated within cradle 17 until plate 22 is completely adhered to the outer surface of cylinder 11. Thereafter, cylinder 11 with plate 22 affixed is removed from cradle and is placed on the printing press (not shown) for the usual printing procedures.

By another method it may be only necessary to raise press cylinder 11 within its mounting on the press and place grid 14 thereunder. Printing plate 22 could then be placed face downwardly on grid and cylinder 11 lowered into contact with the plate whereupon plate 22 can then be wrapped around cylinder 11 as earlier described with cradle 17. By this abbreviated process, press cylinder 11 does not have to be removed from the printing press and plates can be mounted on the press by simply raising cylinder 11 from its normal engaged press position. This method of course would only apply to most presses which have adjustable cylinder mountings thereon.

A second embodiment of the mounting device is shown in FIG. 5 with plate mounting device 30 which includes an adhesive tape supply 32 in the form of a double sided tape roll having a peel-off release paper on one side. Cylinder 45 can be bearingly mounted in device 30 by placing axle hubs 46 thereon and positioning hubs 46 in shallow slots 47 in planar members 48. Tape supply 32 is then unrolled for placing on printing cylinder 45 by wrapping therearound with the exposed adhesive side against cylinder 45. Once the tape has been wrapped around printing cylinder 45, pivotal tape cutting guide 33 which is rotatably mounted in cutting guide slots 49 and includes cutting panel 36 is then rotated into contact with printing cylinder 45. A razor knife (not shown) is then pressed across the top of the tape and into cutting panel groove 37 which may be for example 1/16 of an inch in depth and a straight cut is thereby obtained to insure a smooth outer periphery of printing cylinder 45 as the ends of the tape should abut and not overlap. Thereafter the release paper is removed from the wrapped tape so cylinder 45 will have an adhesive outer surface.

Figure 6:
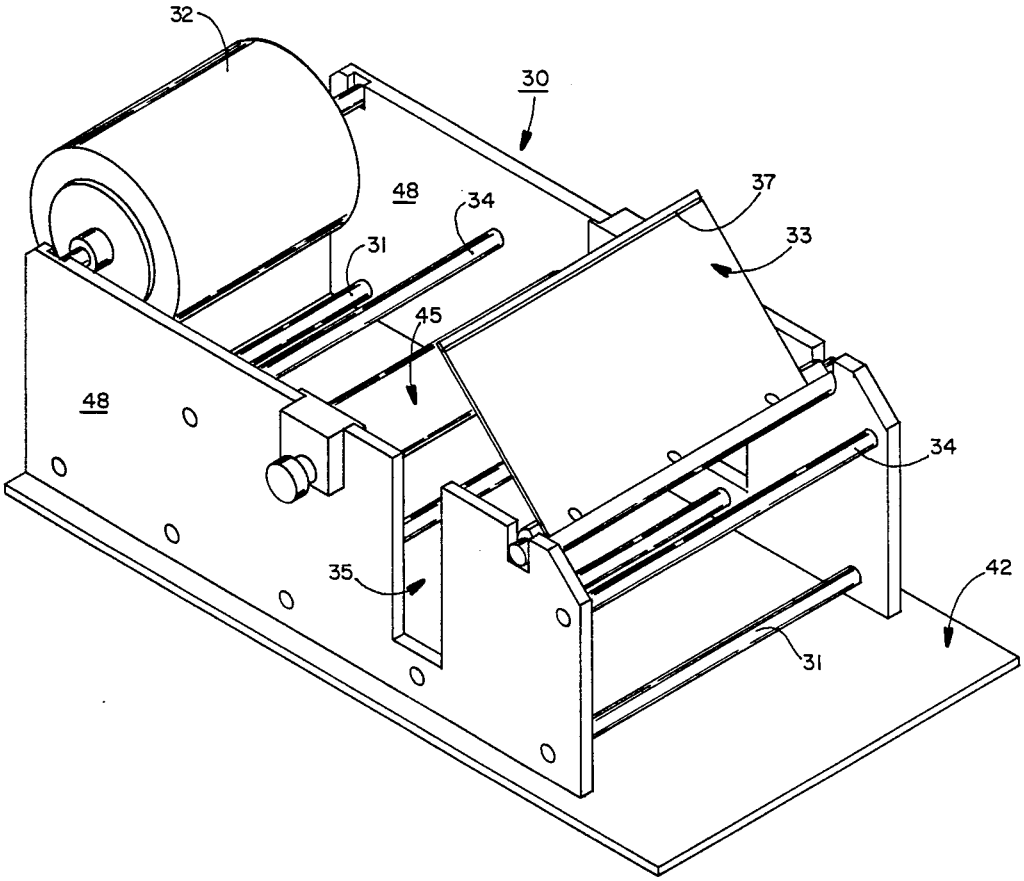
FIG. 6 illustrates the device of FIG. 5 with the tape cutting panel rotated approximately forty-five (45) degrees.

Pivotal tape cutting guide 33 is of course rotated upwardly as shown in FIG. 6 and printing cylinder 45 is removed and then positioned in planar member slots 35 for contacting a printing plate positioned thereunder. Lower lateral supports 31 provide a dual function by both maintaining rigidity of mounting device 30 and providing a rack for postitioning a plate support thereon above base 42. Rails 39 can be attached to the inside of planar members 48 to form a shelf on which, for example, support plate 44 can slide thereon as it passes through mounting device 30. Upper lateral supports 34 also provides rigidity to plate mounting device 30. Lower lateral supports 31 seen in FIGS. 5 and 6 form a rack for a plate support, or plate support shelf 38 having side bars 39 as shown in outline form in FIG. 5 may also be used.

Tension members 55 (FIG. 5) are threadably tightened into one member 48 above lateral supports 31 and serve to guide support plate 44 as it passes through mounting device 30 by forcing support plate 44 against the opposite planar member 48. A coil spring is within tension member 55 and a ball contacts the spring and the ball extends slightly beyond the inside surface of member 48 in which it is located.

Figure 7:
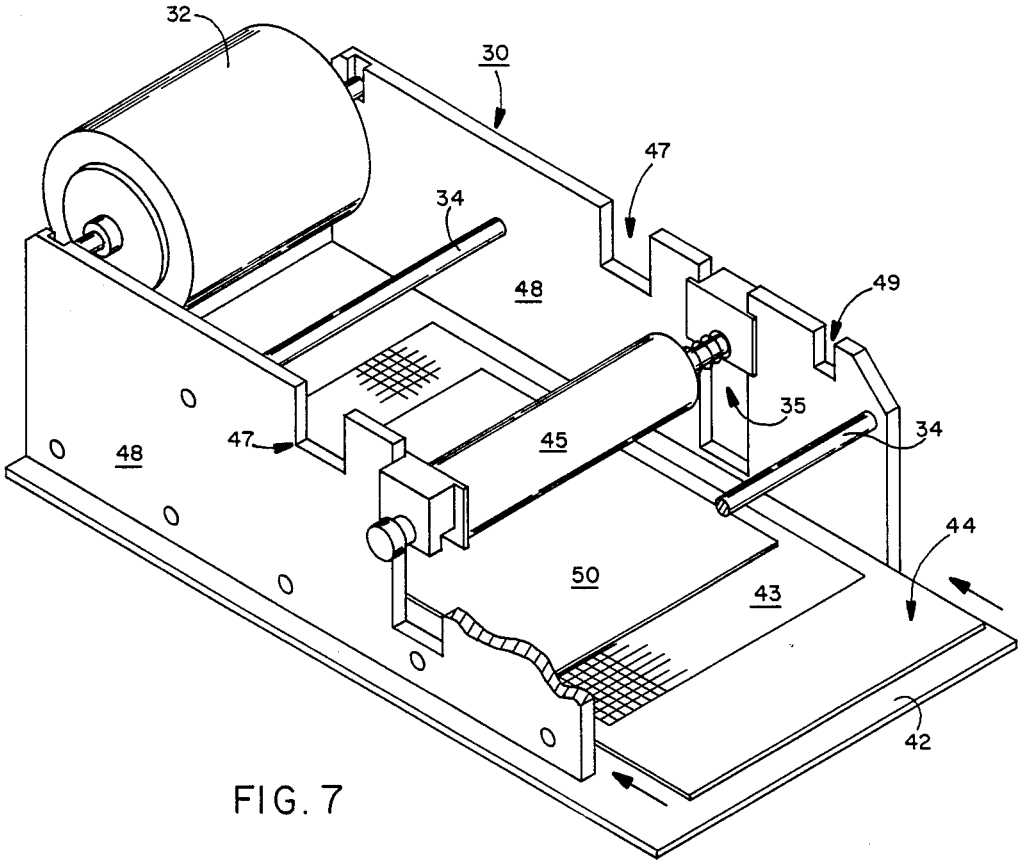
FIG. 7 depicts the device of FIG. 5 with the cutting panel removed in partial cut-away form.
Figure 8:
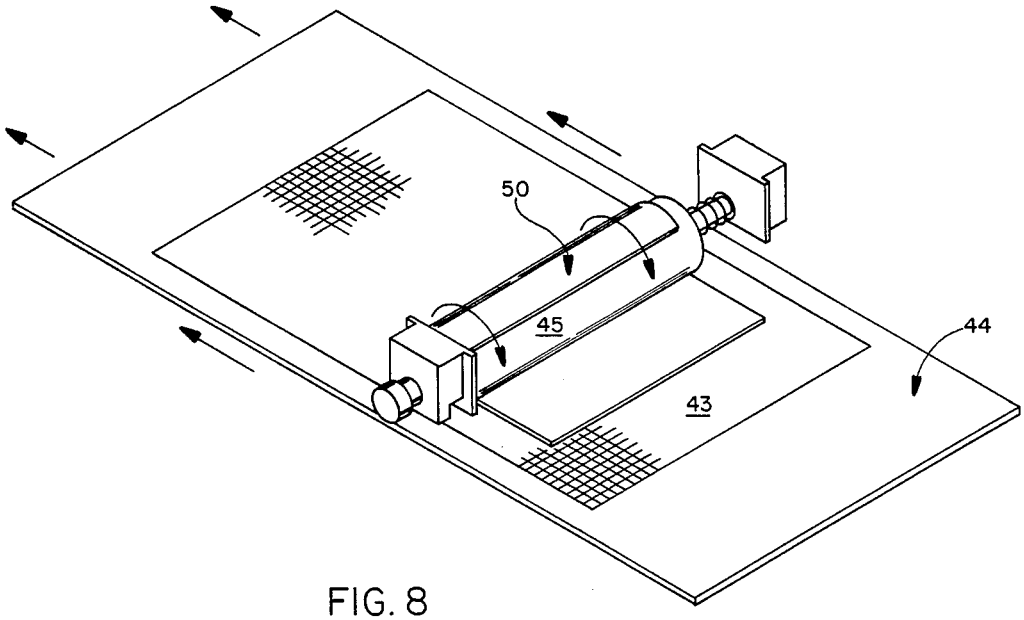
FIG. 8 shows the relative movement of the printing cylinder and the plate support during plate mounting.
Figure 12:
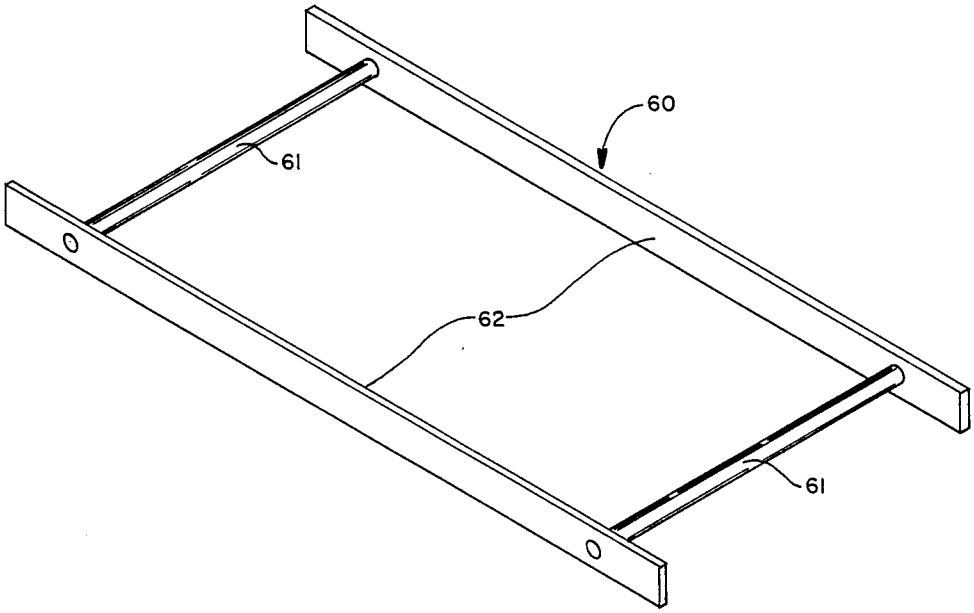
FIG. 12 demonstrates the stacking frame removed from the light table.

As shown in FIG. 12 stacking frame 60 includes side rails 62 joined to cross rods 61 and can be permanently or temporarily affixed to light table 40. Plate support 44 includes a grid portion 43 and plate support 44 is formed from for example, a ⅛ inch transparent acrylic sheet allowing printing plate 50 to be mounted in alignment thereon as shown in FIG. 7. As further seen in FIG. 8, as printing cylinder 45 rotates in a clockwise direction for example, by the manual turning thereof, plate support 44 moves thereunder from right to left in FIG. 8 and printing plate 50 is adhered to printing cylinder 45 which is covered with an adhesive tape from tape supply 32 as earlier explained. As also shown in FIG. 7, printing cylinder 45 is positioned in second slots 35 for plate mounting and of course would be lowered into contact with plate 50.

Figure 9:
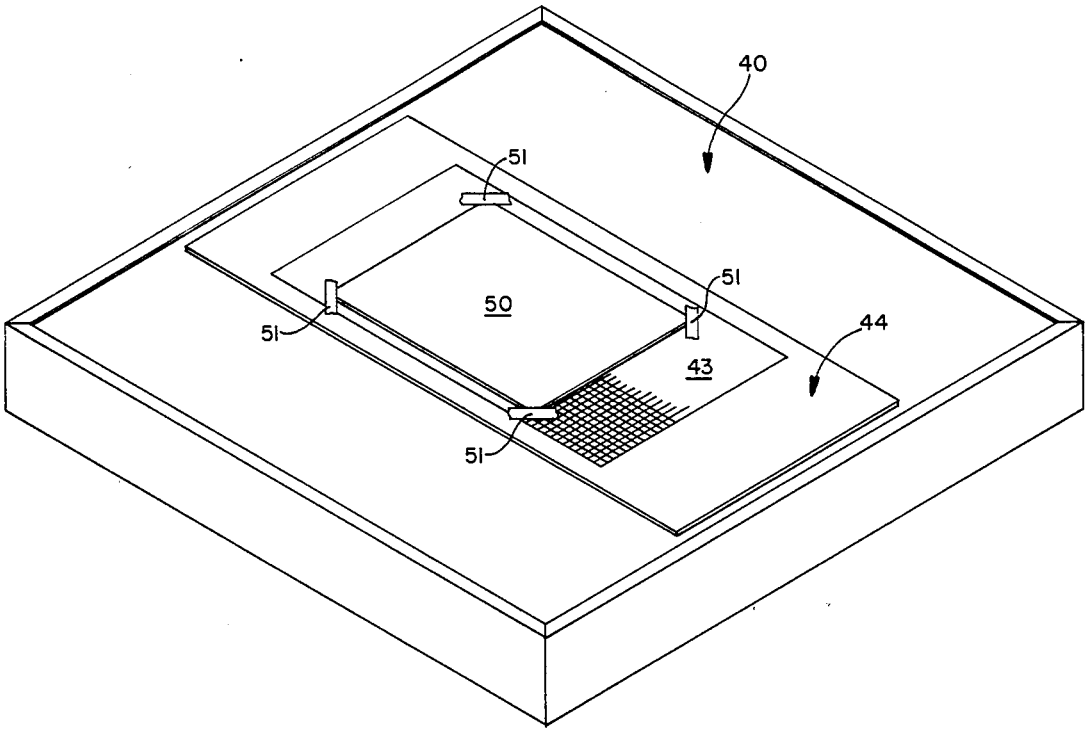
FIG. 9 demonstrates a printing plate taped into position on a plate support on top of a light table.
Figure 10:
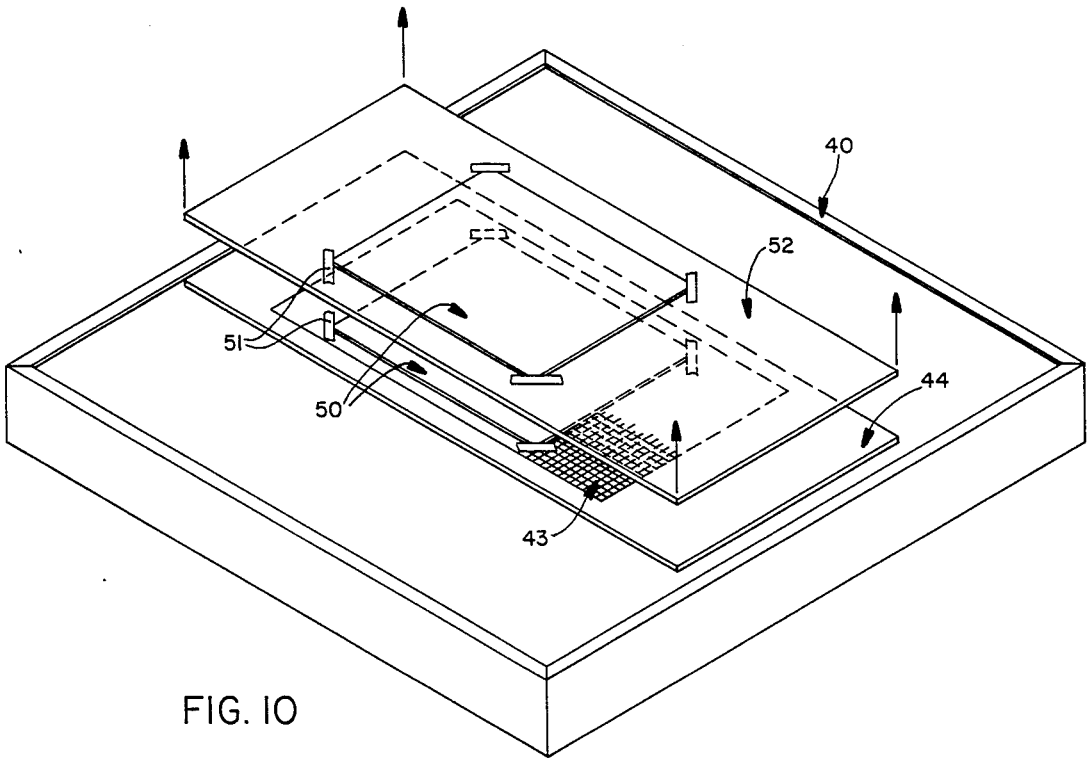
FIG. 10 pictures a first printing plate as seen in FIG. 9 taped to a first plate support with a second printing plate taped to a second plate support which is shown lifted from the first plate support.
Figure 11:
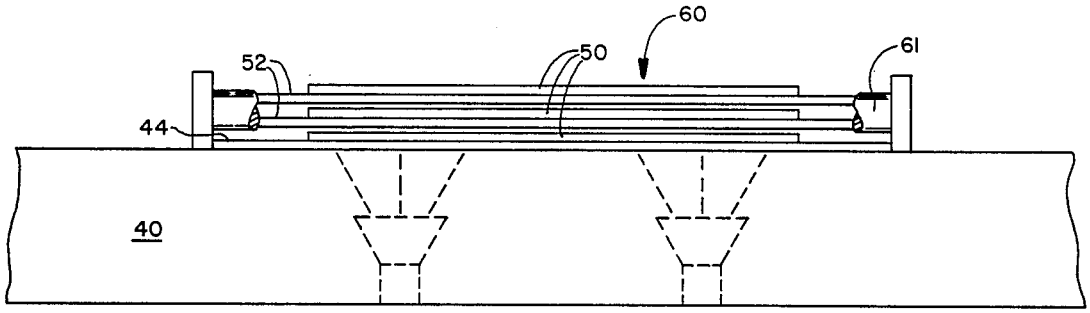
FIG. 11 is enlarged and illustrates three printing plates each secured to one of three individual support plates on a light table within a cut-away stacking frame.

As is well known in the art, printing stock is often printed three (3) or more times with different plates and inks to obtain the desired colors and appearances. As each printing plates must register exactly on the printing stock and therefore each plate must therefore be aligned exactly with the former plate of the previous printing cylinder to insure proper registration. Various registration techniques and methods have been employed in the past with the transparent polymeric plates 50 which are now used. Plates 50 can be easily aligned when used in conjuction with mounting device 30 and can be properly installed on the first and succeeding printing cylinders 45 to insure a correct run and proper registration. As seen in FIG. 9, light table 40 which is conventional and well known in the art sustains plate support 44 having grid portion 43 thereon as earlier mentioned. Light from within table 40 penetrates grid portion 43 to allow transparent plate 50 to be correctly aligned thereon and is temporarily affixed thereto with tape strips 51. The exact location of the mounting of plate 50 is in accordance with the dimensions of printing cylinder 45 and mounting device 30 as would be understood by those skilled in the art. For a single press run for example of black ink or any other single color, plate support 44 with printing plate 50 attached is removed from light table 40 as shown in FIG. 9 and is now positionable within mounting device 30 as seen in FIG. 7. However, if two or more printing colors are desired, multiple support plates can be utilized as shown in FIG. 10 and FIG. 11. Support plate 44 is positioned on light table 40 as shown in FIG. 9 and a first plate 50 is secured to grid portion 43 of support plate 44. Next stacking frame 60 is placed over support plate 44 and a second transparent support plate 52 is then positioned on top of first printing plate 50 inside stacking frame 60. A second printing plate 50 is then aligned with for example the printing on first printing plate 50 on top of support plate 52 and is likewise secured to support plate 52 by tape strips 51. Thus, the print on the second plate is aligned with the print on the first plate. Since support plates 44 and 52 are transparent as are printing plates 50, such alignment of plates 50 can easily accomodate 2,3 or more plates as shown in FIG. 11 and can be stacked within frame 60. Plate supports 44 and 52 may be secured to each other or to light table 40 with tape strips as needed depending on the particular conditions encountered and depending on whether stacking frame 60 is used. Thus, by aligning the printing on one plate 50 with another plate 50, the plates and subsequent printed material will be in correct register.

Plate supports 44 and 52 are formed from a substantially rigid transparent acrylic sheet which may be for example ⅛ of an inch thick and sized to fit within mounting device 30. Stacking frame 60 can be formed with side members 61 and end members 62 made from wood, plastic or other materials to suit individual requirements. A series of printing plates can be mounted on successive cylinders of a printing press or successive plates can be placed on the same cylinder for 2,3 or any multiple number of press runs.

Modifications can be made in the invention as presented herein and the examples and illustrations are merely for explanatory purposes and are not intended to limit the scope of the appended claims.

I claim:

1. A mounting device for positioning a printing plate on a press cylinder comprising: a pair of slotted vertical planar members, lateral supports, said supports positioned between and affixed to said planar members, an adhesvie tape supply, said supply rotatably positioned between said planar members, a pivotable tape cutting guide, said guide including a panel, said panel defining a cutting groove, said guide removably positioned between said planar members, and said planar members defining a first slot and a second slot, said first slot for receiving a press cylinder for attaching tape thereto and said second slot having a depth greater than said first slot for positioning a press cylinder therein for attaching a printing plate thereon.

2. A mounting device as claimed in claim 1 and including an elongated plate shelf, said shelf attached to one of said pair of planar members.

3. A mounting device as claimed in claim 2 wherein said plate shelf is positioned above said lateral supports and below the bottom of the second slot.

4. A method of mounting a transparent flexible printing plate on a press cylinder comprising the steps of:

(a) aligning the plate on a plate support,
(b) temporarily adhering the plate on the plate support,
(c) placing the plate support with the plate attached to a mounting device,
(d) placing a printing cylinder into first opposing slots in the mounting device,
(e) attaching an end of a double sided tape to the printing cylinder,
(f) wrapping the printing cylinder with the tape while rotating the cylinder,
(g) placing a tape cutting guide on the tape,
(h) cutting the tape to form a butt joint of the tape on the cylinder,
(i) removing the cylinder from the first slots,
(j) placing the cylinder into second opposing slots in the mounting device,
(k) lowering a press cylinder into contact with the plate,
(l) attaching one end of the plate to the cylinder, and
(m) rotating the cylinder to enwrap the cylinder with the plate while directing the plate support through the mounting device for removal therefrom.

5. The method of claim 4 wherein the step of aligning a printing plate on a plate support comprises aligning a substantially transparent plate on a rigid plate support.

6. The method of claim 5 and including the step of placing a plate support having a grid thereon over a light table.

* * * * *